US005730312A

United States Patent [19]

Hung

[11] Patent Number: 5,730,312

[45] Date of Patent: Mar. 24, 1998

[54] BAG SUPPLY UNIT AND WASTE RECEPTACLE

[76] Inventor: Chi Mo Hung, Room 6, 14th Floor, Winful Centre 30 Shing Yip Street, Kowloon, Hong Kong

[21] Appl. No.: 747,978

[22] Filed: Nov. 12, 1996

Related U.S. Application Data

[63] Continuation of Ser. No. 167,913, Jun. 17, 1994.

[30] Foreign Application Priority Data

Jun. 19, 1991 [CN] China ..... 91104336.5
Jun. 19, 1991 [CN] China ..... 91104337.3

[51] Int. Cl.[6] ..... B65D 85/66
[52] U.S. Cl. ..... 220/407; 206/390; 206/554
[58] Field of Search ..... 220/407; 206/390, 206/554

[56] References Cited

U.S. PATENT DOCUMENTS 2,214,380 9/1940 Nisbet .
3,481,112 12/1969 Bourgeois .
4,850,486 7/1989 Neibaur ..... 206/390
4,940,200 7/1990 Sawyer et al. .

FOREIGN PATENT DOCUMENTS 2101853 3/1972 France .
2403946 9/1978 France .
2403946 4/1979 France .
1085853 6/1965 United Kingdom .
1085853 10/1967 United Kingdom .
1600982 10/1981 United Kingdom .

*Primary Examiner*—Joseph M. Moy
*Attorney, Agent, or Firm*—Leydig, Voit & Mayer, Ltd.

[57] ABSTRACT

A bag supply unit includes a casing having an opening, a coreless roll of bags contained within the casing for dispensing through the opening, the roll of bags being formed by a continuous flat sleeve in which a plurality of transverse seal lines are provided at regular intervals along the length of the sleeve to form closed ends of the bags and a line of perforations is provided between adjoining bags adjacent and substantially parallel to each corresponding seal line such that the bags can be torn off one-by-one from one end of the sleeve, and ties rolled up with the sleeve and each arranged to be provided for tying each bag when it is torn off. The bag supply unit may be used within a waste receptacle.

13 Claims, 6 Drawing Sheets

BAG SUPPLY UNIT AND WASTE RECEPTACLE

This disclosure is a continuation of patent application Ser. No. 08/167,913, filed Jun. 17, 1994.

BACKGROUND OF THE INVENTION

The present invention relates to a bag supply unit and to a waste receptacle incorporating the same.

It is generally known to provide a roll of bags which is formed by a continuous sleeve sealed at equal intervals along its length with adjacent transverse perforations to define the bags. The bags are to be used one after another and are deigned to be torn off either for use or for disposal after use. Existing waste receptacles are known to incorporate internally such bag supply units such that collected waste can be discarded conveniently with a bag currently in use, which is torn off when full and the next bag then becomes available for use in the receptacle.

For hygienic purpose, the bags containing collected waste should be tied up or otherwise closed before disposal. This normally requires the use of additional means which may not be readily or conveniently available in situ.

The invention seeks to mitigate or alleviate such disadvantage or shortcoming.

SUMMARY OF THE INVENTION

According to a first aspect of the invention, there is provided a bag supply unit which comprises a casing having an opening, a roll of bags contained within the casing for dispensing through the opening, said roll of bags being formed by a continuous flat sleeve in which a plurality of transverse seal lines are provided at regular intervals along the length of the sleeve to form closed ends of the bags and a line of perforations is provided between adjoining bags adjacent and substantially parallel to each corresponding seal line such that the bags can be torn off one-by-one from one end of the sleeve, and ties rolled up with the sleeve and each arranged to be provided for tying each bag when it is torn off, characterised in that the sleeve is rolled up upon itself without a separate supporting core.

According to a second aspect of the invention, there is provided a bag supply unit which comprises a casing surrounding a roll of bags for dispensing through an opening of the casing, said roll of bags being formed by a continuous flat sleeve having a plurality of transverse seals at regular intervals along its length to define corresponding closed ends of the bags and transverse lines of perforations adjacent and substantially parallel to corresponding seals to define corresponding open ends of the bags such that the bags can be torn off away from an end of the sleeve, and a tie provided for each bag for tying the open ends of the bags, each tie being rolled up with the sleeve and each arranged to be released for tying the corresponding bag when it is torn off, characterised in that the sleeve is rolled up upon itself without a separate supporting core.

Preferably, the ties are provided extending along the length of the sleeve.

More preferably, the ties are at least partially cut apart by the lines of perforations.

In a preferred embodiment, the ties are formed of material separate from the sleeve.

In a different preferred embodiment, the ties are formed integrally with the sleeve and arranged to be torn off with the corresponding bags.

Preferably, the ties are provided by a longitudinal edge portion of the sleeve.

In a specific construction, the edge portion of the sleeve is sealed along adjacent the edge to form a strip which provides the ties and a line of perforations to allow the ties to be torn from the side of the sleeve.

Advantageously, the ties have a different colour from the sleeve or the body of the sleeve.

It is preferred that the sleeve is longitudinally folded to reduce its effective width when rolled up.

Preferably, the sleeve is longitudinally pleated.

The bag supply unit may further include self-attaching means to attach the bag supply unit to a support surface.

The bag supply unit may comprise a plurality of said casings containing respective of said rolls of bags and further including a board supporting the casings.

According to a third aspect of the invention, there is provided a waste receptacle incorporating internally any of such a bag supply unit, said bag supply unit being arranged to provide a bag with its open end disposed around an open end of the receptacle for receiving waste.

It is advantageous that the receptacle is collapsible.

Preferably, the bag supply unit is arranged to fit the base of the receptacle so as to prevent the receptacle from collapsing.

The waste receptacle may further include self-attaching means for attaching the waste receptacle to a support surface.

BRIEF DESCRIPTION OF THE DRAWINGS

The invention will now be more particularly described, by way of example only, with reference to the accompanying drawings, in which.

DESCRIPTION OF PREFERRED EMBODIMENTS

Figure 1:
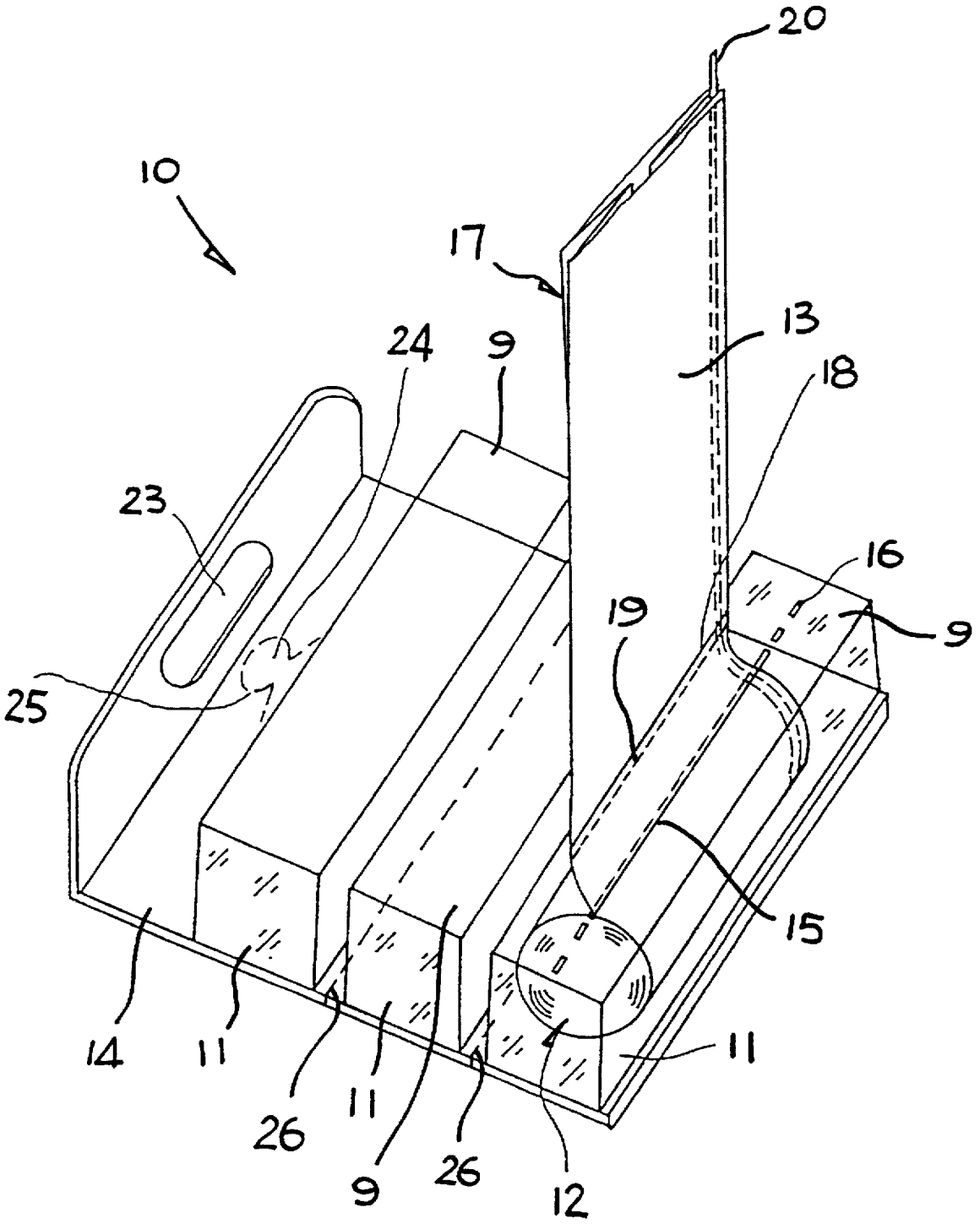
FIG. 1 is a perspective view of an embodiment of a bag supply unit in accordance with the invention.
Figure 2:
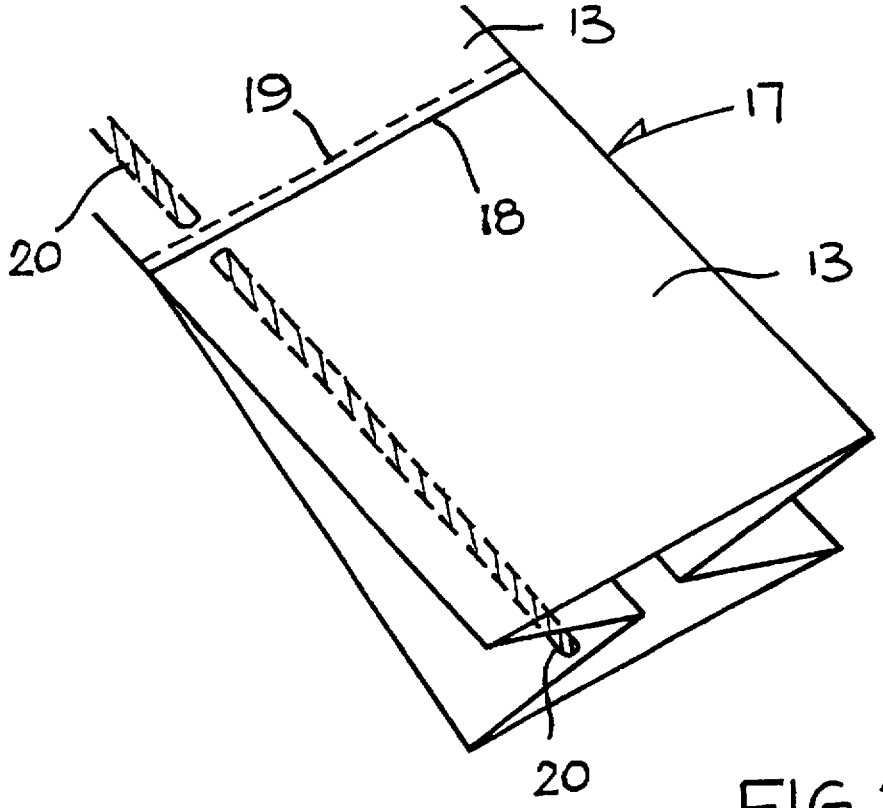
FIG. 2 is a fragmentary perspective view of a sleeve forming the bags of the bag supply unit of FIG. 1.

Referring first to FIGS. 1 and 2 of the drawings, there is shown a bag supply unit 10 embodying the invention, which bag supply unit 10 is formed by three casings 11 each containing a roll 12 of bags 13, and a board 14 supporting the casings 11 in a mutually parallel and spaced apart manner. Each casing 11 is made by folding a sheet of transparent plastics material to form a rectangular box, and has in its top wall 9 a slit opening 15 which is to be formed by a user by piercing open a perforated line 16.

The roll 12 of bags 13 is formed by a continuous flat plastics sleeve 17 having a plurality of transverse seal lines 18 at regular intervals along its length. A transverse line of perforations 19 is provided in the sleeve 17 between adjacent bags 13 close to the corresponding seal line 18, thereby forming two distinct bags. In other words, each seal line 18, except the very last one inside the roll 12, is accompanied by a corresponding perforated line 19. It will be appreciated that the seal lines 18 and perforated lines 19 define the closed and open ends of the bags 13, respectively.

In order to reduce the length of each roll 12, the corresponding sleeve 17 is folded inwardly or pleated along both longitudinal edges, namely to form a pair of confronting double pleats as is best understood from the cross-section which is sometimes known as a gusset configuration.

The sleeve 17 is provided with a string 20 which is placed within the pleat along one longitudinal edge, as more clearly shown in FIG. 2. The string 20 is cut or partially severed into separate lengths by the perforated lines 19, and is rolled up with the sleeve 17 thereby being retained within the roll 12.

In use, the outer end of the sleeve 17 is firstly pulled out through the opening 15 by a user until the first bag 13 is completely exposed so that it can be torn off for use. It will be appreciated that the associated length of string 20 is also retrieved at the same time with the bag 13 and is then available for later use for tying closed the open end of the bag 13. Immediately upon tearing off of the first bag 13, the end of the next bag 13 is exposed outside the casing 11 through the opening 15 ready for future use.

Figure 3:
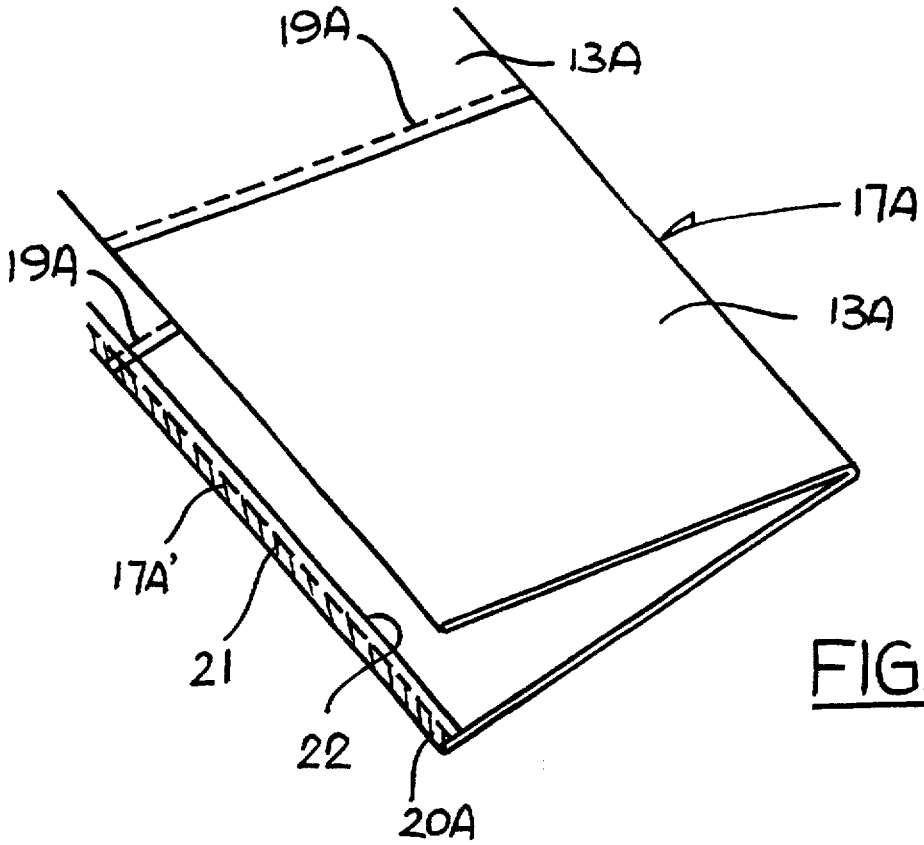
FIG. 3 is a fragmentary perspective view of a sleeve capable of replacing the sleeve of FIG. 2.

FIG. 3 is now also referred to, which shows a different sleeve 17A suitable for replacing the earlier sleeve 17. The sleeve 17A is folded once longitudinally about its centre line to reduce its effective width. The sleeve 17A is not provided with a separate string but instead an integral tie 20A which is formed by one longitudinal edge portion or strip 17A' of the sleeve 17A. The edge portion 17A' is arranged to be torn away from the body of the sleeve 17A along a perforated line 21 immediately behind which the sleeve 17A is closed by a seal line 22.

As is shown, the edge portion 17A' and the tie 20A are also partially cut by transverse perforated lines 19A in the sleeve 17A such that the same length will be torn off with an associated bag 13A from the sleeve 17A. The tie 20A may be left attached with the bag 13A when the latter is in use or torn away therefrom for tying closed the open end of the bag 13.

The roll of bags 13A formed by the sleeve 17A is not only relatively simpler to manufacture but also has the advantage that the tie 20A does not add any thickness to the roll and will not get lost or mis-placed but is immediately available for use when needed.

In either sleeve 17 or 17A, the string 20 or tie 20A is coloured or has a colour different from that of the sleeve 17 or the rest of the sleeve 17A for easy identification.

As shown in FIG. 1, the sleeve (and the sleeve 17A) 17 is rolled up upon itself without a separate core, thereby saving space and avoiding additional weight.

The board 14 is provided with an integral folded-up handle 23 for easy carrying and an integral lug 24 which is formed by piercing a corresponding shaped perforated line 25. An adhesive double-sided tape or pad (not shown) is provided on the back of the lug 24 for attaching the whole bag supply unit 10 onto a wall or any other support surface. Between adjacent casings 11, the board 14 is perforated along line 26 for tearing to separate the casings 11 to form individual bag supply units or for tearing away an empty casing.

Figure 4:
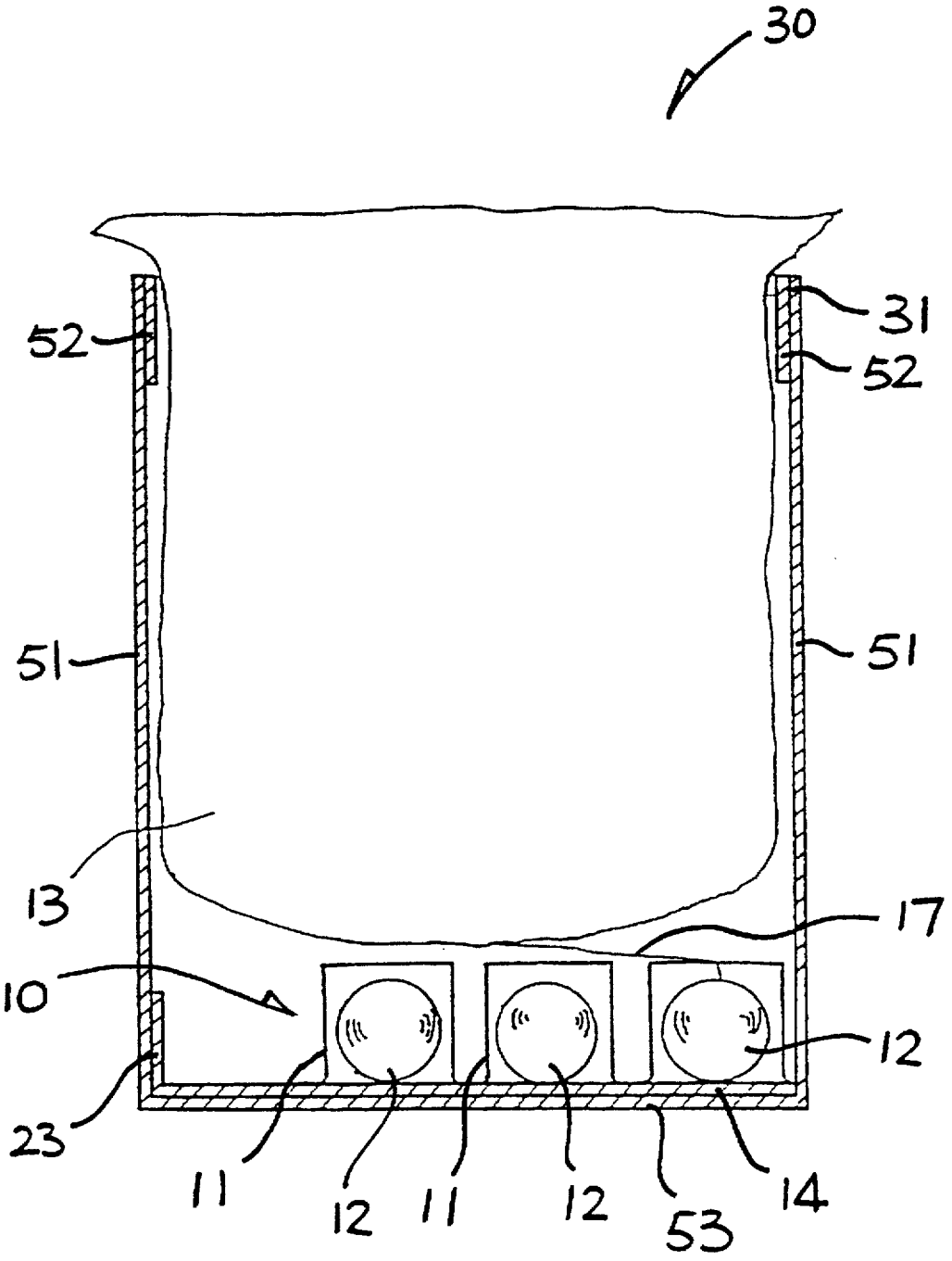
FIG. 4 is a sectional side view of an embodiment of a waste receptacle in accordance with the invention, incorporating the bag supply unit of FIG. 1.

Referring now to FIG. 4 which shows a box-like waste receptacle or bin 30 embodying the invention, the bag supply unit 10 is incorporated at the bottom. The first or outermost bag 13 is opened up with its open end disposed around a rim 31 of the open top end of the bin 30 for receiving waste collected in the bin 30. At an appropriate time usually when the bag is full, the bag 13 in use is lifted up from the bin 30 and then torn off for disposal. For hygienic purpose or tidiness, the open end of the bag 13 is to be tied closed before disposal. It will be appreciated that when one roll 12 of bags 13 is used up, an adjacent roll 12 may then be used.

Figure 5:
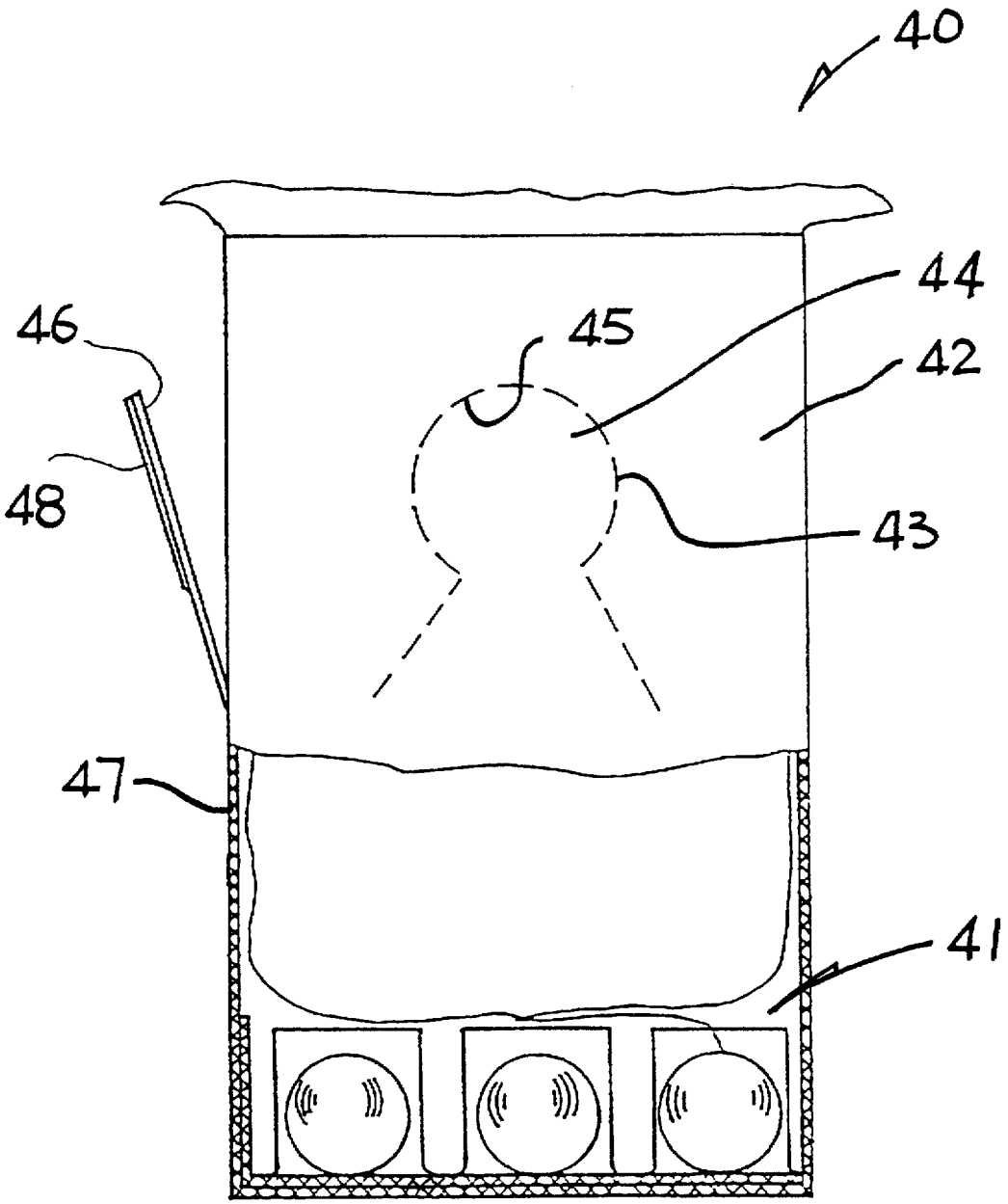
FIG. 5 is a sectional side view of a somewhat different embodiment of a waste receptacle in accordance with the invention, incorporating a different bag supply unit also embodying the invention.

FIG. 5 shows a second embodiment of a waste bin 40 which incorporates a bag supply unit 41 slightly different from the bag supply unit 10 described above. One side wall 42 of the waste bin 40 has a shaped perforated line 43 for providing an integral lug 44 upon piercing open or a hole 45 by means of which the waste bin 40 may be supported on a hook (not shown). A similar lug 46 is provided on an adjacent side 47 of the waste bin 40s on which lug 46 an adhesive double-sided pad 48 is provided to attach the waste bin 40 to a wall or any other support surface (not shown).

Figure 6:
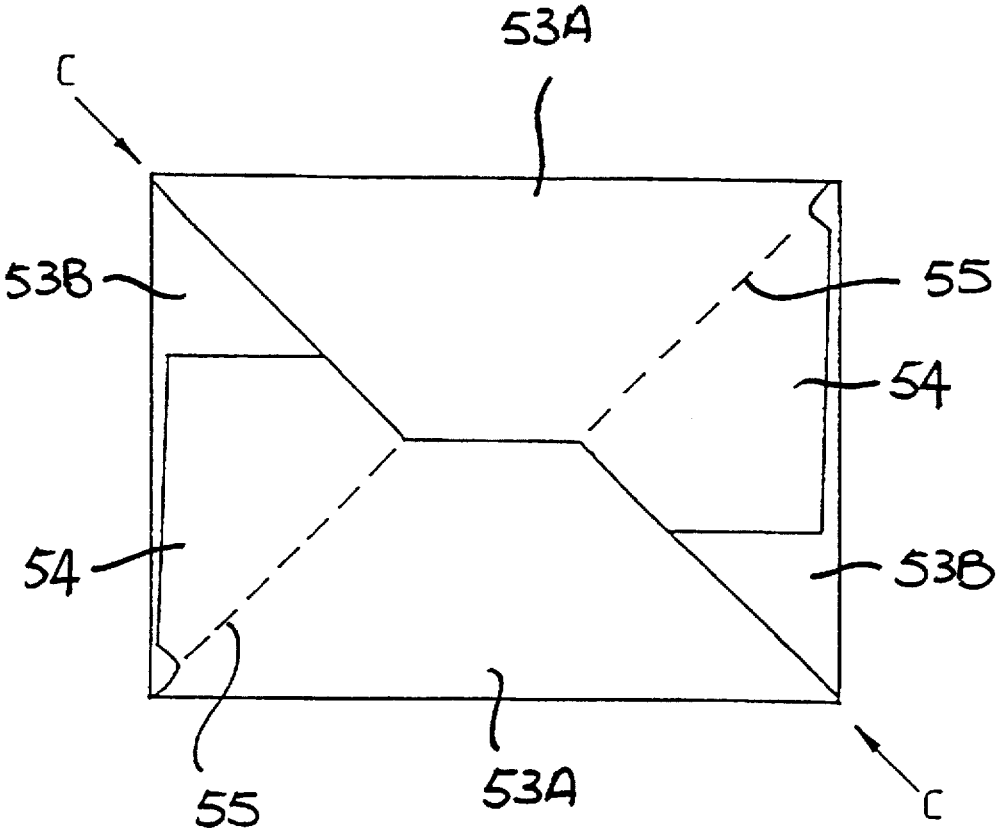
FIG. 6 is an underneath plan view of the waste receptacle of FIG. 4.
Figure 7:
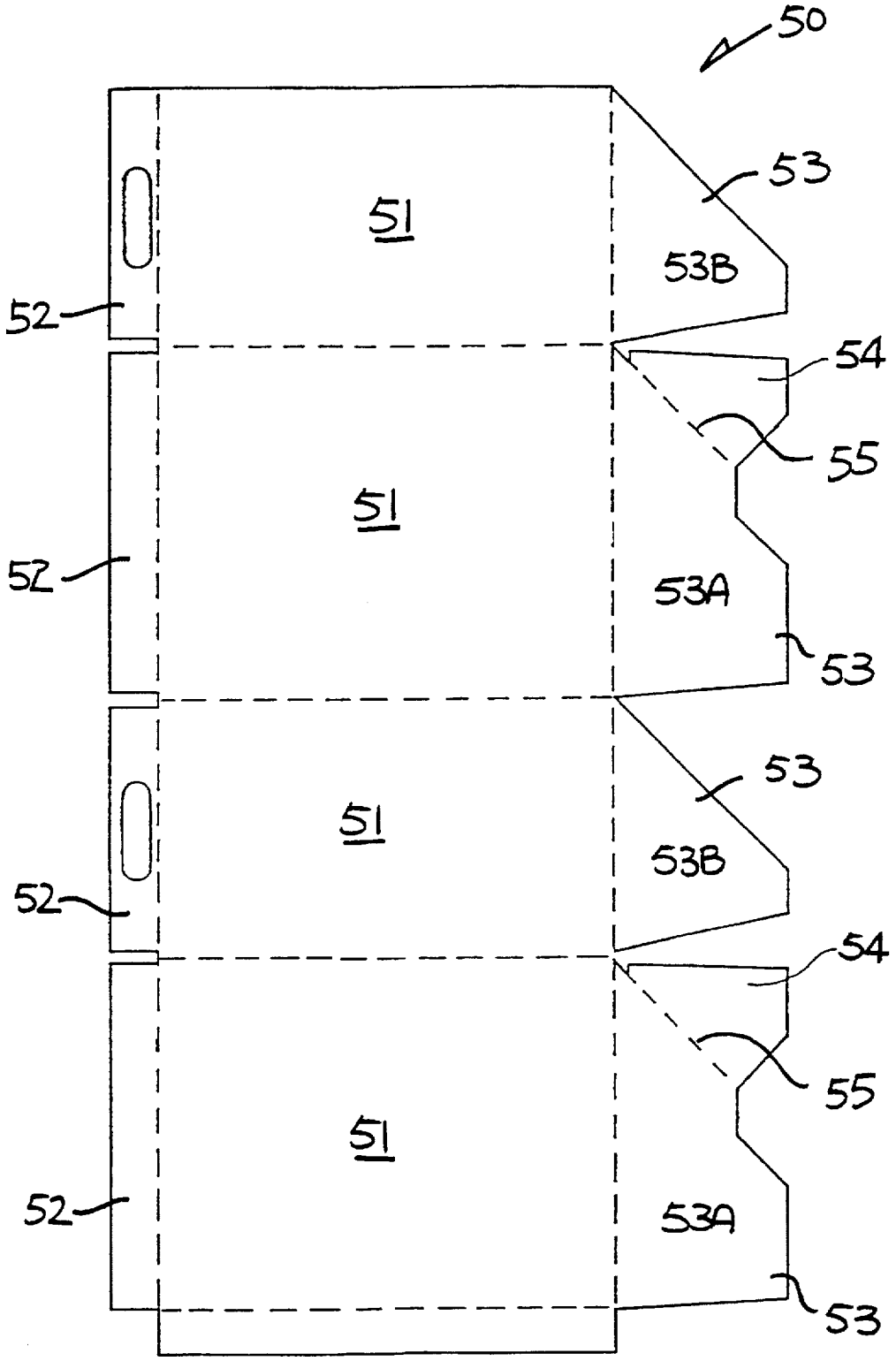
FIG. 7 is a blank forming the waste receptacle of FIG. 4.

Reference is now made to FIGS. 6 and 7 of the drawings. The waste bin 30 is formed by a blank 50 having a series of four joined rectangular panels 51 providing the respective side walls of the waste bin 30. Four narrow strips 52 are provided on one side of the panels 51 to be folded inwards to form the rim 31 of the top open end of the waste bin 30. The opposite side of the panels 51 has four corresponding flaps 53 divided into two interlaced groups of flaps 53A and 53B having identical shapes in each group and corresponding to opposite sides of the waste bin 30. The flaps 53A have respective fold-lines 55 defining corresponding sub-flaps 54 which are wholly attached by glue onto the corresponding adjacent flaps 53B when the panels 51 are closed to form the waste bin 30, as shown in FIG. 6, whereby each pair of joined flaps 53A and 53B forms half a base wall of the waste bin 30. This construction permits the waste bin 30 to be collapsed for storage when compressed at opposite corners as illustrated by arrows C of FIG. 6, with the base wall automatically folded inwards while separating into two said halves each folded along the corresponding fold-line 55.

As can be seen from FIG. 4, the supporting board 14 of the bag supply unit 10 fits squarely within on the bottom wall of the waste bin 30, namely on the flaps 53, thereby preventing the waste bin 30 from collapsing as described above.

The invention has been given by way of example only, and various modifications of and/or alterations to the described embodiment may be made by persons skilled in the art without departing from the scope of the invention as specified in the appended claims.

I claim:

1. A waste receptacle having an open top end and a bottom end and containing within the bottom end a bag supply unit arranged to provide a bag with its open end disposed around the top end of the receptacle for receiving waste, the bag supply unit comprising a casing surrounding a roll of bags for dispensing through an opening of the casing, the roll of bags being formed by a continuous flat plastic sleeve having a plurality of transverse seals at regular intervals along its length to define corresponding closed ends of the bags and transverse lines of perforations adjacent and substantially parallel to corresponding seals to define corresponding open ends of the bags such that the bags can be torn off away from an end of the sleeve, and a tie provided for each bag, each tie being rolled up with the sleeve and arranged to be released for tying a corresponding one of the bags when the corresponding bag is torn off, wherein the receptacle is collapsible and the bag supply unit is arranged to fit the bottom end of the receptacle so as to prevent the receptacle from collapsing.

2. A waste receptacle as claimed in claim 1 wherein the sleeve is rolled up upon itself without a separate supporting core.

3. A waste receptacle as claimed in claims 1 wherein the ties extend along the length of the sleeve.

4. A waste receptacle as claimed in claim 3 wherein the ties are at least partially cut apart by the lines of perforations.

5. A waste receptacle as claimed in claim 4 wherein the ties are formed separately from the sleeve.

6. A waste receptacle as claimed in claim 4 wherein the ties are formed integrally with the sleeve and arranged to be torn off with the corresponding bags.

7. A waste receptacle as claimed in claim 6 wherein the ties are formed along a longitudinal edge of the sleeve.

8. A waste receptacle as claimed in claim 7 wherein the sleeve is sealed along the longitudinal edge and a line of perforations extends along the longitudinal edge to allow the ties to be torn from the sleeve along the longitudinal edge.

9. A waste receptacle as claimed in claims 1 wherein the ties have a different color from the sleeve.

10. A waste receptacle as claimed in claims 1 wherein the sleeve is longitudinally folded to reduce its effective width when rolled up.

11. A waste receptacle as claimed in claim 10 wherein the sleeve is longitudinally pleated.

12. A waste receptacle as claimed in claims 1 wherein the bag supply unit comprises a plurality of the casings containing respective rolls of bags and further including a board supporting the casings.

13. A waste receptacle as claimed in claims 1 further including self-attaching means for attaching the waste receptacle to a support surface.

* * * * *